US005466339A

United States Patent [19]

Legge

[11] Patent Number: 5,466,339

[45] Date of Patent: Nov. 14, 1995

[54] METHOD OF MAKING AND USING A PAPER MAKER FELT

[75] Inventor: Robert W. Legge, W. Bridgewater, Mass.

[73] Assignee: Tamfelt, Inc., Canton, Mass.

[21] Appl. No.: 283,398

[22] Filed: Jul. 29, 1994

Related U.S. Application Data

[62] Division of Ser. No. 973,689, Nov. 9, 1992, abandoned.

[51] Int. Cl.[6] ..... D21F 7/10; D21F 7/08

[52] U.S. Cl. ..... 162/200; 28/141; 28/142; 139/383 A; 162/358.2; 162/900; 162/904; 264/171.23; 428/232; 428/234

[58] Field of Search ..... 162/199, 200, 162/272, 273, 358.2, 900, 904; 28/141, 142; 139/383 A, 383 AA; 428/234, 300, 232; 264/171

[56] References Cited

U.S. PATENT DOCUMENTS

| | | | |
|---|---|---|---|
| 2,883,734 | 4/1959 | Draper, Jr. . | |
| 3,613,258 | 10/1971 | Jamieson | 162/358.2 |
| 3,653,097 | 4/1972 | Kerber | 24/33 C |
| 4,006,760 | 2/1977 | Romanski et al. | 139/383 A |
| 4,026,331 | 5/1977 | Lees et al. | 139/383 A |
| 4,123,022 | 10/1978 | Dutt et al. | 139/383 A |
| 4,382,987 | 5/1983 | Smart | 428/212 |
| 4,438,789 | 3/1984 | MacBean | 139/383 A |
| 4,574,435 | 3/1986 | Luciano et al. | 24/33 C |
| 4,601,785 | 7/1986 | Lilja et al. | 162/199 |
| 4,695,498 | 9/1987 | Sarrazin et al. | 428/121 |
| 4,698,250 | 10/1987 | Talonen et al. | 428/58 |
| 4,737,241 | 4/1988 | Gulya | 162/199 |
| 4,755,260 | 7/1988 | Sakuma | 162/199 |
| 4,761,329 | 8/1988 | Halker et al. | 428/222 |
| 4,764,417 | 8/1988 | Gulya . | |
| 4,775,446 | 10/1988 | Eschmann | 162/348 |
| 4,902,383 | 2/1990 | Penven | 162/199 |
| 4,911,683 | 3/1990 | Legge et al. | 474/255 |
| 5,015,220 | 5/1991 | Legge et al. | 474/256 |

*Primary Examiner*—Karen M. Hastings
*Attorney, Agent, or Firm*—Salter & Michaelson

[57] ABSTRACT

A papermaker felt that is formed in a conventional manner and the ends thereof being interconnected at a seam to form an endless construction. Extruded monofilaments are secured in a machine direction to the underside of the felt in spaced parallel relation and overlie the area of the seam, wherein the seam area is protected from abrasion and the spaces between the monofilaments define channels for expressing water therethrough in the use of the felt in the endless form thereof in the press section of a paper making machine.

1 Claim, 2 Drawing Sheets

METHOD OF MAKING AND USING A PAPER MAKER FELT

This is a division of application Ser. No. 07/973,689 filed Nov. 9, 1992, now abandoned.

BACKGROUND OF THE INVENTION

The present invention relates to a papermaker felt having an improved seam, and more particularly relates to a papermaker felt, wherein the felt includes spaced, parallel extending monofilaments that are formed on the underside thereof and that provide protection for the seam and further define water channels for the expressing of water therethrough when the felt is used in a press section of a papermaking machine.

Prior to the instant invention, technology in papermaker felts has advanced to the point where the felts whether woven or endless, are so constructed that they may be separated prior to installation and then seamed together when mounted on a papermaking machine. Thus, conventional seamed felts provide a convenient manner of mounting the felt in place on the rolls of the papermaking machine without having to dismantle the machine as was conventional in the use of the heretofore known endless belt type of felt. Examples of papermaking felts that have their ends joined in a seam are illustrated in the following U.S. Patents: Draper U.S. Pat. No. 2,883,734; Kerber U.S. Pat. No. 3,653,097; Romanski et al U.S. Pat. No. 4,006,760; Lees et al U.S. Pat. No. 4,026,331; Dutt et al U.S. Pat. No. 4,123,022; MacBeau U.S. Pat. No. 4,438,789; Luciano et al U.S. Pat. No. 4,574,435; Lilya et al U.S. Pat. No. 4,601,785; Sarrazin et al U.S. Pat. No. 4,695,498; Talonen et al U.S. Pat. No. 4,698,250; Halker et al U.S. Pat. No. 4,761,329; Eschman U.S. Pat. No. 4,775,446; Legge et al U.S. Pat. No. 5,015,220.

One of the disadvantages of the conventional seam felt as known heretofore, is that the seam often leads to machine vibration problems in the seam area. Heavy roll nip pressure can accentuate any non-uniformity in thickness in the seam area that results in an unacceptable paper product. Another disadvantage is that the heavy roll nip pressures may create a bump in the non-uniform water flow pattern in the seam area, which could create a water dam and possibly break down the wet paper sheet as the seam passes through a hard nip. Still another disadvantage of the conventional seamed felt is that oftentimes paper stock will bleed through the seam area because of non-uniform water flow and overall porosity. Problems have also been experienced in the conventional seam felt in that the seam is inherently prone to excessive wear due to the fact that it may be protected only by a thin layer of fiber or flap which is usually loosely bound to the body of the felt. The flap may be penetrated with resin to effect stabilization and resistance to wear, but this could alter the porosity in the area or create great difficulty in the joining of the ends of the fabric. Conventional seam felts are also prone to impart a mark to the sheet due to non-support of the seam and non-uniform water flow, especially later in the life of the felt when the protective flap has been worn away.

It is also known, as illustrated in the U.S. Patent to Jamieson U.S. Pat. No. 3,613,258, to provide longitudinally extending channels on the underside of a papermaking felt for the purpose of improving the expressing of water from the felt. In the Jamieson patent the channels were formed by extruding spaced parallel extending plastic monofilament onto the underside of the felt to define the channels. Although the channels as formed in the Jamieson felt were satisfactory for the purpose of removing water from the felt, the Jamieson felt was formed endless, and thus the formation of the water expressing channels as taught by Jamieson were not available in a seamed felt that was separated at the seam and thereafter joined at the ends thereof in the use of the felt in a papermaking machine.

As will be set forth hereinafter, the subject invention provides for the use of plastic monofilaments on the underside of a seamed felt to form water expressing channels therein.

SUMMARY OF THE INVENTION

The present invention relates to a papermaker felt for use in a papermaking machine and includes a base fabric that is formed to define spaced opposed ends that are movable into adjacent relation with respect to each other for securement by a pin, pintle or connecting member at a seamed area. The base fabric has an outer surface for receiving a paper sheet thereon in the operation of the machine and has an inner surface that defines the underneath side of the fabric. A pin member extends through the seamed area for releasably joining the opposed ends of the fabric when the ends are located in the adjacent position that defines the seamed area, the fabric thereby being formed in an endless configuration in the use thereof. Joined to the inner surface of said fabric in spaced parallel relation are a plurality of plastic monofilaments that define a plurality of parallel extending water channels, the monofilaments extending into and through the seamed area and being severed at the seamed area. The severed portions of each monofilament are located in abutting relation to provide for continuity of the parallel extending water removal conduits on the underside of the fabric when the felt is passed through nip rollers of a press section of the papermaking machine, wherein the monofilaments act to protect the seamed area and further provide a wear resistant overlay therefor during the use of the felt.

Accordingly, it is an object of the present invention to provide an improved seam for use in a papermaking felt, wherein plastic monofilaments are secured to the inner surfaces thereof to define water expressing channels thereon.

Another object of the invention is to provide a plurality of spaced, parallel monofilaments in a papermaking felt for protecting the seamed area from abrasion.

Still another object is to maintain uniform water flow channels through the seamed area in a papermaking felt with no interruption in water flow therethrough.

Still another object is to maintain integrity of the fabric structure through the seamed area of a papermaking felt for assisting uniform water flow by providing spaced apart, extruded monofilaments on the inside surface thereof.

Still another object is to provide a papermaker felt wherein uniformity of thickness and porosity are maintained.

Still another object is to provide a papermaker felt that is less prone to bleed through and to the likelihood of accumulating dirt and other materials that tended to be accumulated in prior known felts It is still a further object of the present invention to provide an improved papermaker pin seam in a papermaker felt and to teach a method of manufacture thereof.

Other objects, features, and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
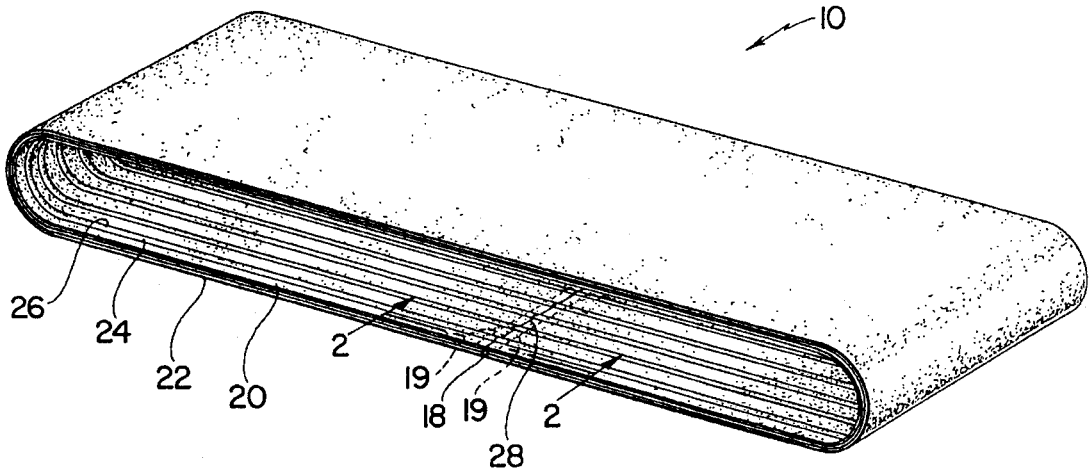
FIG. 1. is a perspective view of a papermaker felt having a seam area and including a plurality of monofilaments that are fixed to the inner surfaces of the felt to form a plurality of parallel extending channels thereon.
Figure 2:
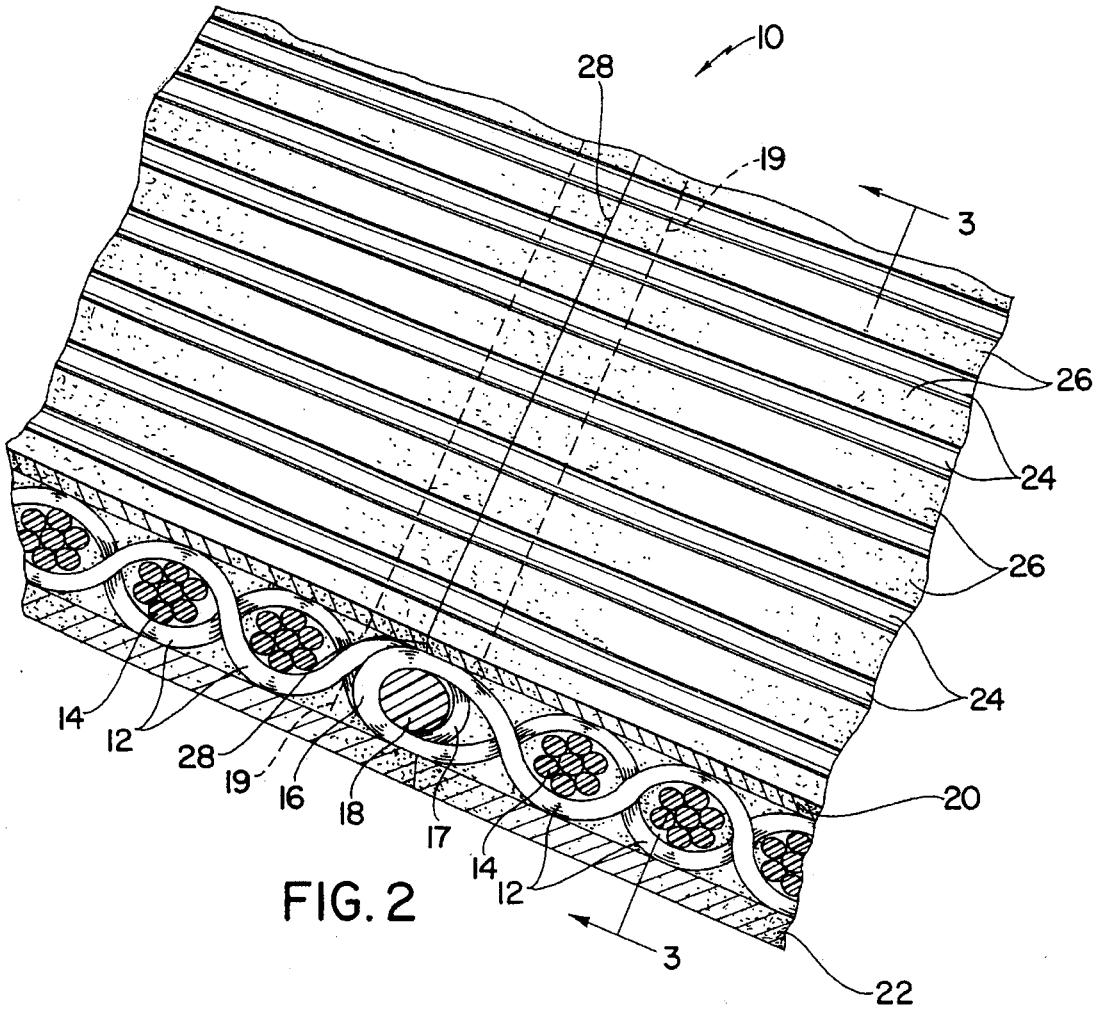
FIG. 2. is an enlarged perspective sectional view of a portion of the felt as embodied in the subject invention taken along lines 2—2 in FIG. 1 and illustrating the respective positions of the seam fabric loops, the securing pintle and the extruded monofilaments as joined to the underside of the felt.

Referring now to the drawings, and particularly to FIG. 1, the felt embodied in the present invention is illustrated and is generally indicated at 10. The felt 10 as shown, is defined by a typical base fabric that is initially formed having opposed ends and that is made endless by the positioning and interdigitation of loops through which a pintle is threaded in order to join the two fabric ends together. The construction of the fabric and the seam joining means may be formed in any conventional manner, and in this connection, a needled felt is preferred, and as shown in FIG. 2, the felt 10 as needled includes a base fabric defined by warp yarns 12 and filler yarns 14. The warp and filler yarns 12 and 14 are woven on a loom in any conventional manner and may be formed of any material normally employed in the manufacture of papermaking fabrics. It is also contemplated to form a felt without any yarn structures or to form a felt of a single yarn structure. However, the materials from which the yarns 12 and 14 are formed and the manner of weaving or forming the fabric therefrom or the specific type of pin seam formed in the felt 10 form no part of the present invention.

In conventional weaving of the warp and filler yarns 12 and 14 to form the base fabric 10, conventional end seam loops 16 and 17 are formed by weaving in the loops or by specifically forming loops in any known manner in the fabric ends. The opposed fabric ends are thereafter joined together by interdigitation of the loop ends 16 and 17 forming a laterally extended passageway 19 between the opposed ends which are thereafter connected together by a pintle 18 that is threaded through the formed end loops 16 and 17 as located in the passageway 19. Other methods of joining the fabric ends may be utilized in accordance with accepted practices as disclosed in the aforementioned U.S. Patents that relate to seamed felts.

Following the joining of the two ends of the felt base fabric which creates an endless belt, the felt is threaded onto a conventional papermaker felt needle loom, and inner and outer fiber batts or webs 20 and 22 may be needled into the joined fabric base by needling techniques that are known to those skilled in the art of producing papermaker felts. After the web or batt material has been sufficiently needled and consolidated into the fabric of the felt 10, the fabric may be further processed by heat treatment, application of a resin material thereto, singeing or other known processes that are required for a particular papermaking application. Preferably however, the fabric is sent directly to the machine for applying the plastic monafilaments after which further processing may be required.

In order to avoid the problems experienced heretofore in attempting to uniformly remove water from a paper sheet carried by a seamed fabric, the present invention utilizes a plurality of parallel extending monofilaments 24 that are adhered to the reverse side of the felt base fabric. As will be described the spaced apart monofilaments 24 define channels that are employed for removing water from the felt. In the subject invention, in order to apply the monofilaments 24 to the felt, the felt is removed from the needling machine and is then mounted on rollers at an extrusion station with the inside surface i.e., paper machine rollside surface, facing up for receiving the extruded plastic monofilaments 24 thereon. The monofilaments 24 are applied in parallel, spaced apart relationship and extend in the machine direction. The monofilaments 24 may be applied from 4 to 20 monofilaments per inch, but the application of 10 to 12 monofilaments to the lineal inch is preferred. The diameter of the monofilaments may range in size from 0.010 to 0.100 inches but the preferred diameter is approximately 0.035 inches.

Figure 3:
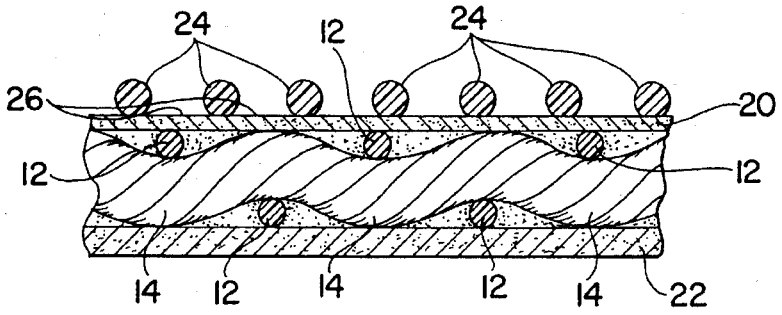
FIG. 3 is a sectional view taken along lines 3—3 in FIG. 2.

Referring again to the FIGS. 2 and 3, the spaced monofilaments 24 are formed of a synthetic plastic material and extend in the machine or warp direction of the joined belt as made endless by the pin seam. The monofilaments may be formed of any suitable plastic material examples of which are polyamides, polyesters, polyolefins, polyurethanes, or vinyls or other high molecular weight synthetic polymers. The plastic monofilaments as described are also preferably applied in hot melt form and are adhered to the fabric material when extruded thereon.

By locating the monofilaments 24 in the manner as illustrated, a plurality of longitudinally extending channels 26 are defined that form water conduits for conducting water expressed from the paper sheet and felt 10 to a dispersal area as the paper sheet and felt are carried through the press section of the papermaking machine. As described, the monofilaments 24 are applied to the underside surface of the base fabric 10, and in this connection, the monofilament beads 24 are laid on the underside of the base fabric in hot melt form so as to adhere thereto. It is also contemplated that preformed monofilament yarns can be applied by a suitable adhesive; or a solvent can be employed for rendering preformed monofilament tacky, whereafter the tacky monofilament is applied to the felt for permanently adhering the monofilament thereto.

It is also preferred that the base fabric have a web or batt 20 needled to the inside surface to form a base to which the molten plastic monofilaments 24 can be adhered. In the art of needling felts, it is also known to have a fiber surface formed on the inside surface of the felt by utilizing certain needling techniques which carry a predetermined amount of web fiber from the base surface layer of the felt, through the felt to the backside or inside surface thereof. The adherence of the monofilaments 24 to a fibrous base is preferred over the attachment of the filaments to a smooth yarn base, since the adherence to a fibrous base by the monofilaments 24 represents a much stronger attachment.

Although the preferred manufacturing process provides for moving the felt 10 from the needle loom to the extrusion station without processing between manufacturing stations, it is also contemplated that after the needling operation is completed, the felt may be further processed by cutting the batt as indicated at 28 along the seamed area removing the pintle 18, then opening the seam when desired or necessary to the passageway 19. Thus if a pintle or loop is damaged in the needling process, its repair can be accomplished by opening the seam as required. If the seamed area is opened in the felt 10 prior to applying the monofilaments 24, for reasons of inspection or repair; upon re-seaming, the seam on the inside surface of the felt may need to be protected during the extrusion process. A careful cutting of the batt or fibrous surface produces a flap or batt cover at the cut 28 which remains over the actual seam area. This cover acts as a support for the extruded hot monofilament and prevents the hot extrudate from seeping into the loop structure of the interdigitated loops 16 and 17 and onto the pintle 18. The molten material also acts as a binder for the fibers of the seam flap covering the seam loop area of the passageway 19.

In certain seamed felts having different loop configurations at each end thereof the ends of the felt may not closely abut one another to make a tight-fitting seam or if the felt has to be separated prior to the extruding operation of the monofilaments 24, protection for the loops from the molten resin must be provided during the extrusion of the monofilaments onto the felt. In this case, and if the fibrous flap is not available, a protective material such as a soluble resin, soluble fiber, putty or the like is inserted into the seam area in the passageway 19 over and between the interdigitated loops in order to prevent the molten resin from congealing into the open spaces between the loops. After the extrusion of the monofilaments 24 onto the felt, the soluble protective material is easily removed during subsequent processing of washing, treating, etc. and the tough plastic monofilament then bridges the gap between the fabric ends.

It is understood that whatever method is used for preparing the base fabric for the extrusion of the monofilaments 24, onto the base fabric, the extrusion process is carried out in the same manner, and the resultant seamed felt after extrusion is still an endless felt which has extruded monofilaments secured thereto and that includes a connecting member for holding the felt ends together after the finishing processes have been completed. The felt fabric is finally processed by carefully cutting the batt or web that is located at the seam. The extruded monofilaments on the inside surface of the felt are also carefully severed immediately below the pintle position. In this connection, the monofilaments 24 are cut in such a manner that when the felt ends are separated and are rejoined on the paper making machine to form the endless felt, the extruded monofilaments are located in abutting relation and the channels between the monofilaments 24 are continuous through the seam area.

After cutting the batt fibers and the extruded monofilaments, the pintle 18 is extracted from the loops 16 and 17 and the two felt ends are separated. The end loops are inspected and if necessary, are cleaned of extraneous fiber. The used pintle is discarded and a new pintle is prepared for shipment with the felt to the customer for insertion through the loops 16 and 17 in a manner known in the art of seaming fabrics after the felt is mounted on a papermaking machine at the user's site.

As described herein, the present invention provides a unique and effective means for receiving and conducting water expressed through the paper sheet and felt, regardless of the type of seam commonly used in modern seamed papermaker felts. Not only does this improved seam provide a novel means for insuring effective, uniform removal of water from the paper sheet, but it also renders the seam vibration free, more wear resistant, more uniform in running parameters and more resistant to sheet marking and, of course, insures greater longevity of the felt.

While there is shown and described herein certain specific structures embodying the invention, it will be manifest to those skilled in the art that various modifications and rearrangements of the parts or processes may be made without departing from the spirit and scope of the underlying inventive concept and that the same is not limited to the particular forms herein shown and described except insofar as indicated by the scope of the appended claims.

What is claimed is:

1. A method of making and using a papermaker felt, wherein the felt includes a fabric composed of yarns and fibrous batt materials and that is formed with spaced opposed ends having exposed end loops that are formed by the yarns that extend outwardly of said opposed ends, the opposed ends being secured together by a pintle that extends through said loops to form a pin seam area through which a loop channel extends for receiving said loops therein, and said fabric further including an outer surface and an inner surface, comprising the steps of locating said felt at a plastic extrusion station in endless form with the pintle inserted into said channel that receives said loops in the seam area and with the inner surface of said felt facing outwardly, covering the loops in the seam area with a protective overlay, extruding a plurality of resinous plastic monofilaments in molten form onto said inner surface of said fabric in spaced parallel relation to define a plurality of water conducting channels, wherein said plastic monofilaments extend over said seam area, said protective overlay preventing said molten resinous material from entering into and interfering with the integrity of the loop channel at said seam area, placing a soluble material selected from the group consisting of soluble resin, soluble fiber, and soluble putty over said seam area to form said protective overlay prior to the extrusion of said plastic monofilament onto the inner surface of said fabric, severing said plastic monofilaments at the seam area to form adjacent severed ends of said plastic monofilaments, extracting said pintle from said seam area, cleaning extraneous fibrous batt material from the loop channel at said seam area, separating the two opposing ends of the fabric for the installation of the fabric on a papermaking machine by locating the inner surface thereof and the plastic monofilaments thereon facing inwardly and inserting said pintle through said loops in said seam area to unite the opposed ends of said felt on said papermaking machine, wherein the severed ends of said plastic monofilaments are disposed in adjacent relation and provide for continuity of said parallel extending channels that form water removal conduits on the underside of said felt when said fabric is passed through rollers of a press section of the papermaking machine, said plastic monofilaments further acting to protect said pin seam area and providing a wear-resistant overlay therefor during the use of the felt in the papermaking machine.

* * * * *